United States Patent [19]

Ritchey

[11] 4,365,436

[45] Dec. 28, 1982

[54] DISPLAY PANEL AND METHOD OF MAKING SAME

[76] Inventor: Eugene B. Ritchey, Rte. 2, Box 58, Brighton, Colo. 80601

[21] Appl. No.: 144,699

[22] Filed: Apr. 28, 1980

Related U.S. Application Data

[63] Continuation-in-part of Ser. No. 23,547, Mar. 26, 1979, abandoned, which is a continuation of Ser. No. 755,646, Dec. 30, 1976, abandoned.

[51] Int. Cl.[3] ..... G09F 19/00; B05D 3/00; B41L 1/16; B26D 3/08

[52] U.S. Cl. ..... 40/615; 264/293; 40/616; 427/276; 427/277; 101/150; 83/880; 428/172; 434/81

[58] Field of Search ..... 40/616, 615; 101/150, 101/401.1; 282/28 R, 27.5; 400/120, 134.4, 134.5; 427/270, 271, 264, 272, 273, 274, 276, 277; 434/84, 81; 219/229, 227; 346/77 E, 77 R, 135.1, 139 C; 83/879, 880; 264/293; 428/29, 40, 142, 172, 212, 526

[56] References Cited

U.S. PATENT DOCUMENTS

| | | | |
|---|---|---|---|
| 469,033 | 2/1892 | Allen | 40/615 |
| 1,596,017 | 8/1926 | Harmisch | 427/277 |
| 1,674,047 | 6/1928 | Bombard | 427/277 |
| 2,135,538 | 11/1938 | Sherman et al. | 282/28 R |
| 2,224,043 | 12/1940 | Fluckiger | 427/272 |
| 2,739,909 | 3/1956 | Rosenthal | 346/135.1 |
| 3,035,267 | 5/1962 | Vögtlin | 346/77 R |
| 3,063,864 | 11/1962 | Norman | 101/150 |
| 3,198,688 | 8/1965 | Yoder | 427/276 |
| 3,320,089 | 5/1967 | Bourgeois | 346/135.1 |
| 3,379,814 | 4/1968 | Bracey, Jr. | 83/880 |
| 3,453,097 | 7/1969 | Hafner | 83/880 |
| 3,574,657 | 4/1971 | Burnett | 427/271 |
| 3,578,538 | 5/1971 | Prosser et al. | 40/615 |
| 3,683,408 | 8/1972 | Kinley et al. | 346/77 R |
| 3,699,644 | 10/1972 | Cocca | 83/880 |
| 3,940,864 | 2/1976 | Kanzelberger | 40/616 |
| 3,961,112 | 6/1976 | Genevitz et al. | 40/616 |
| 4,027,052 | 5/1977 | Thompson | 427/272 |

*Primary Examiner*—Gene Mancene

*Attorney, Agent, or Firm*—Fields, Lewis, Pittenger & Rost

[57] ABSTRACT

The process of displaying indicia on a panel includes forming a panel with a substratum of a first selected material and at least one superstratum of a second contrasting material attached to the substratum. At least the superstratum is meltable, and preferably both layers are formed of tough, pliable, weatherproof plastic such as polyurethane. A heated indicia-forming tool is pressurally applied selectively to the superstratum to melt localized portions of its material throughout its thickness and force it out of the path of movement of the tool, leaving corresponding portions of the substratum exposed to define indicia with a contrasting background. The method can include also melting a portion of the substratum, having a contrasting color to the superstratum and causing a portion of the substratum to flow up over the melted raised portion of the superstratum along the edge of the melted area to form highly visible indicia on the panel.

6 Claims, No Drawings

DISPLAY PANEL AND METHOD OF MAKING SAME

This application is a continuation-in-part of my copending U.S. application Ser. No. 023,547, filed Mar. 26, 1979, now abandoned, which in turn is a continuation of my U.S. application Ser. No. 755,646, filed Dec. 30, 1976, now abandoned.

TECHNICAL FIELD

The product of this invention lies in the field of indicia displaying panels and the invention is particularly directed to a method of applying tools to suitable panel material to produce visible indicia on the panels with highly contrasting backgrounds.

BACKGROUND ART

Many different types of indicia bearing panels have been produced by many different methods for use in various ways and have been generally satisfactory for limited purposes, although they suffered disadvantages in manufacture or durability or utility. Examples of such articles or methods are found in such U.S. patents as Patent Nos. 1,363,897 to Morgans; 2,494,412 to Simkins; 3,096,596 to Magnuson; 3,552,051 to Ritchey; and 3,965,598 to Avery.

Hides and furs have been marked for identification with a hot iron in the manner of cattle branding, but such a system has no practical utility in making labels or signs for display purposes. It is also known to make marks on wax paper with graphite stylus, but such marks are difficult to distinguish and the material is unsuitable for tags, labels, and the like. A good sign can be made by laminating layers of rigid plastic of contrasting colors, forming raised characters on the laminate and then grinding or machining the raised portions of the outer layer to expose the inner layer. Such a system is limited to a commercial operation requiring a considerable amount of machinery and equipment. Labels or tags having considerable utility have been made by stamping or punching out an article of suitable shape from a tough pliable plastic sheet and marking characters thereon with some flexible paint. This produces a durable label or tag in a very simple manner, but it has been found that the markings fade and crack and also tend to peel off or be destroyed by abrasion in a relatively short time.

DISCLOSURE OF THE INVENTION

The method and product of the present invention overcomes the various disadvantages mentioned above and provides a tag, label or sign which is very durable and provided with permanent markings and requires a minimum of equipment and skill to make. The method may be practiced in a shop or in the field.

Generally stated, a tag, label or sign may be made from a laminate of tough, pliable, weatherproof plastic sheet material such as a suitable polyurethane compound, and in its simplest form includes a substratum of a first selected color and a superstratum of a second selected contrasting color, at least the superstratum being meltable. The panel may have any desired configuration, depending on the purpose for which it is to be used.

The indicia-forming tool may be generally like a soldering iron, heated electrically or otherwise, and the character forming portion may be shaped to form a complete character or may be a simple stylus.

To form the desired indicia, the heated tool is pressurally applied to the superstratum and melts localized portions of its material throughout its thickness and the pressure of the tool forces such material out of the path of movement of the tool into beads on each side thereof. This operation leaves the corresponding portions of the substratum exposed to define indicia of the first color with a background of the second color. Since both color layers are weatherproof, the result is a panel bearing permanent high visibility indicia. Since the indicia are recessed, they are protected from abrasion and to a great extent from contact by any material which would tend to discolor or obscure them.

In one application, a tool is used having preformed, raised indicia formed thereon which is curved about a radius and is heated to a temperature above the melting point of the superstratum and the substratum. To form indicia on the panel, the tool is brought in contact with the superstratum and moved in a generally perpendicular direction through the superstratum into the substratum. The radius of the tool causes the melted superstratum to be flushed to the sides of the indicia to form a bead along the edge of the indicia. Also, the melted portion of the substratum will be flushed up over this bead to form a layer of material on the bead of contrasting color to the surrounding panel, i.e., the exposed superstratum. This results in the formation of highly visible indicia on the panel which can be read even when the panel is at a highly oblique angle to the eyes of the observer.

A second superstratum may be attached to the second face of the substratum to bear additional indicia. The second superstratum may be of a different color from the first in order to provide added coding possibilities.

BRIEF DESCRIPTION OF DRAWINGS

Various other advantages and features of novelty will become apparent as the description proceeds in conjunction with the accompanying drawing, in which.

BEST MODE FOR CARRYING OUT THE INVENTION

Figure 1:
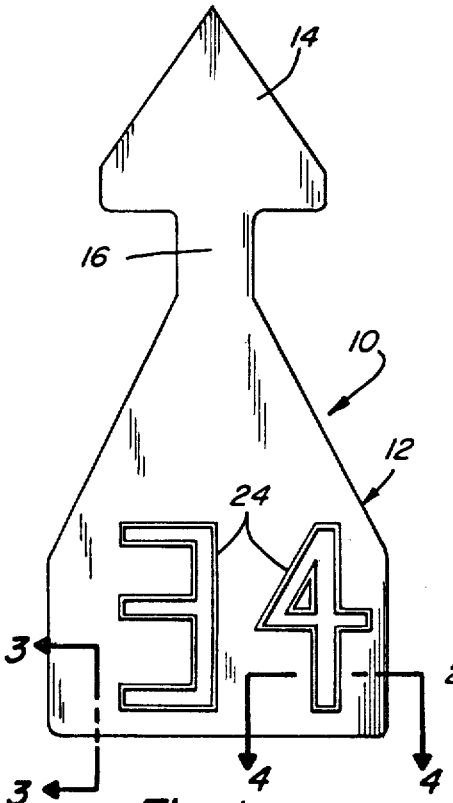
FIG. 1 is a side elevational view of a tag bearing indicia formed in accordance with the principles of the invention.
Figure 2:
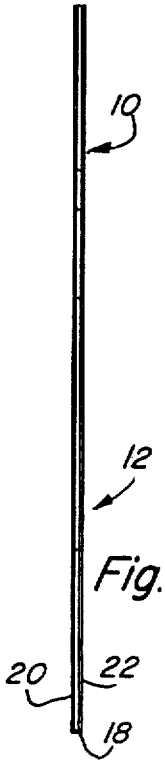
FIG. 2 is an edge view of the tag of FIG. 1.

A typical panel made in accordance with the present invention is schematically illustrated in FIG. 1, in which a stock identifying tag 10 includes a panel 12 connected to a head 14 by a neck 16. A tag of this basic shape is shown in the U.S. patent to Ritchey, Pat. No. 3,552,051, and its purpose and manner of use are fully disclosed therein. The indicia shown in the Ritchey patent are applied with a flexible paint and the tag is very satisfactory when first put in use. However, the indicia are gradually weathered and are abraded by contact with bushes, fences, etc.

Figure 3:
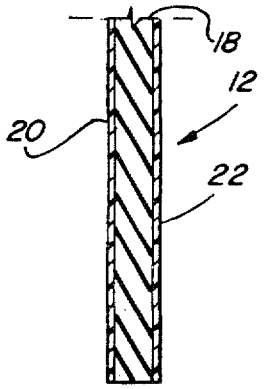
FIG. 3 is an enlarged sectional view taken on line 3—3 of FIG. 1.
Figure 5:
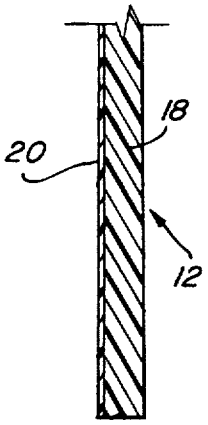
FIG. 5 is a view similar to FIG. 3 showing a two layer laminate.

As best seen in FIGS. 3 and 5, the panel 12 comprises a substratum 18 having a superstratum 20 attached to one face thereof, as in FIG. 5, and a second superstratum 22 attached to its second face, as in FIG. 3. The material of the layers may be a polyvinyl compound or a polyurethane compound, but is preferably the latter, and is tough, pliable, and weatherproof, and is meltable upon application of sufficient heat, solidifying again upon cooling and retaining its original properties.

Layer 18 is of a first selected color, such as yellow, and layer 20 is of a second selected contrasting color, such as black. Layer 22 may be of the same color as layer 20 or a different color, such as red, to provide for additional coding. It should be understood that although the layers are discussed throughout the specification as being of contrasting colors, they could in fact have other contrasting properties which would lend them to mechanical reading techniques. For example, layer 18 could contain a magnetic material which could be read by an electronic scanner. Similarly, layer 18 could contain an oxide which would reflect a different amount of heat than the other layer 20 and could be read by an infrared scanner.

Figure 7:
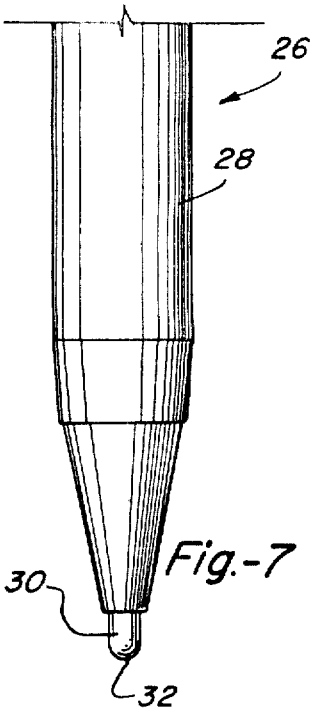
FIG. 7 is a partial schematic view of an indicia-forming stylus.

In order to produce indicia 24 as in FIG. 1, a tool 26 shown in FIG. 7 is provided. The tool may take various forms, but is here indicated as a suitable handle or grip 28 carrying a stylus 30 having a rounded tip 32. The handle may contain an electrical heating unit contacting or surrounding the inner end of the stylus, or the stylus may be heated by exposure to a flame or other heat source. Instead of a simple stylus, the handle may carry a forming member having a special shape to produce a complete character.

Figure 4:
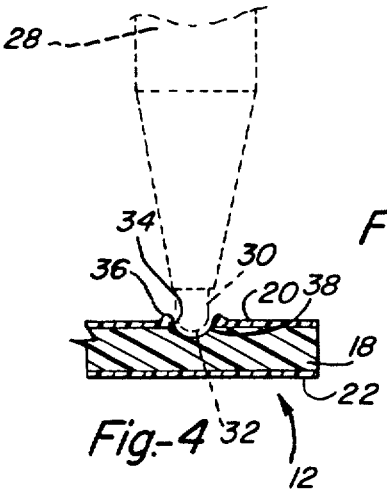
FIG. 4 is an enlarged sectional view taken on line 4—4 of FIG. 1.

With the panel laid on any suitable substantially flat surface, the heated tool is manipulated to bring the stylus into the position shown in FIG. 4. The stylus is then pressed down to melt layer 20 throughout its thickness and moved as desired. The tip 32 acts like a piston which hydraulically forces or flushes the melted material out of its path to harden along the side edges 34 as a bead or ridge 36 and to form a recess which, from side elevational view, as in FIG. 1, will correspond to whatever indicia it is desired to produce. Upon removal of the tool, the corresponding portion of the surface of layer 18 will be exposed to define permanent visible indicia of a first color surrounded by a background of a contrasting color. Although some of the displaced material may slough off, the remainder, upon cooling, solidifies in displaced position above the surface extending along the margins of the indicia to form ridges 36 which increase their visibility and serve as protective barriers against abrasion and the like. If it is desired to produce a deeper impression for greater visibility, the stylus may be pressed down with greater force to produce a shallow groove 38 in layer 18. If additional indicia are desired, they are formed in the same way in the second layer 22. If a tool comparable to a branding iron is used, it is pressed down in a direction normal to the surface of the panel and the material of the outer layer is displaced in the same way.

Figure 8:
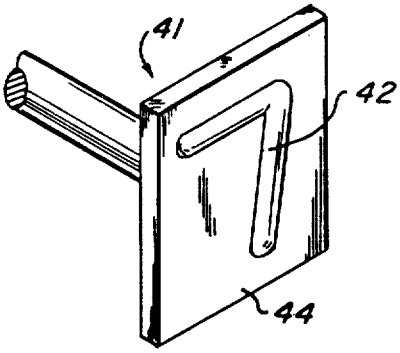
FIG. 8 is a perspective view of a tool having preformed indicia thereon.
Figure 9:
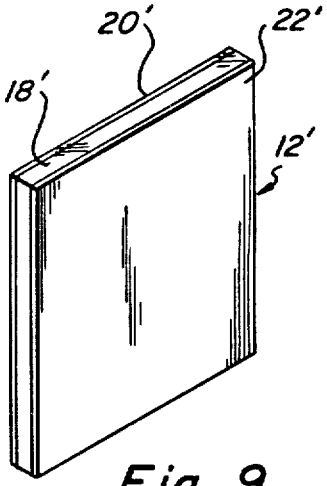
FIG. 9 is a perspective view of a laminated panel on which indicia is to be formed.
Figure 10:
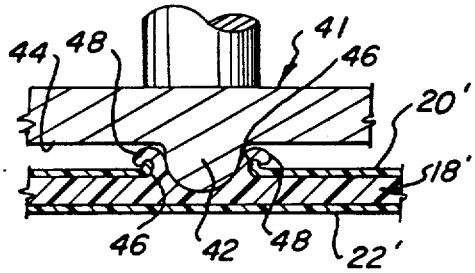
FIG. 10 is a cross-sectional view, taken along line 10—10 of FIG. 11, but showing the tool of FIG. 8 in contact with the panel to form the indicia.
Figure 11:
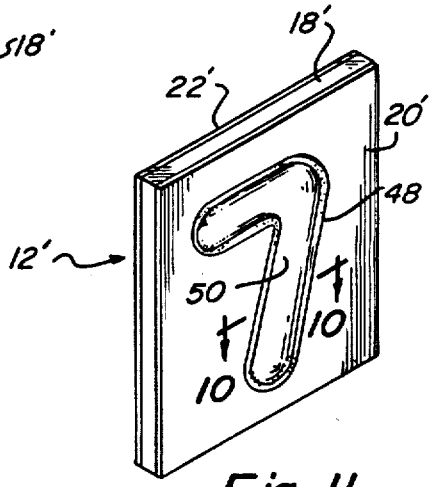
FIG. 11 is a perspective view of the panel of FIG. 9 after the indicia is formed.

A tool 41 is shown in FIG. 8 wherein a preformed indicia 42 is formed as a raised element 42 on surface 44. A panel 12' is shown in FIG. 9 having a substratum 18' and superstratums 20' and 22' on opposite sides thereof as shown. In order to form indicia on this panel, tool 41 can be brought into contact with the surface of the panel as shown in FIG. 10 wherein the element 42 is moved perpendicularly through superstratum 20' and is formed as a radius so that it flushes the melted portion of superstratum 20' upwardly along the side edges to form a ridge or bead 46. The element 42 also melts a portion of substratum 18' which is flushed up over the edges of bead 46 and solidifies there to form a border 48 which has a contrasting color to the remaining surface of superstratum 20'. Thus, an indicia 50 is formed on panel 12' as best seen in FIG. 11 having a border 48 of contrasting color to the remaining surface of superstratum 20' thereby providing an indicia which can be seen even when the surface of the panel is at a very oblique angle to the eyes of the viewer.

In the presently preferred form of the panel, the thickness of the superstratum is only a small proportion of the thickness of the substratum. The thickness of the latter is generally in the range of about 40 to 60 thousandths of an inch and the thickness of the superstratum may be in the range of about 2 to 6 thousandths of an inch. The preferred ratio of the thickness of the superstratum to the thickness of the substratum is from about 5 percent to about 15 percent. These thicknesses are illustrative only for one use, it being understood that different thicknesses and ratios may be used for different applications of this invention.

Figure 6:
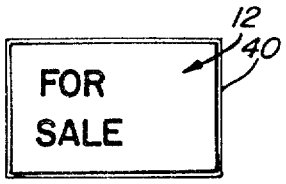
FIG. 6 is an elevational view of a panel with a rigid backing.

The panel described above may be used for a stock tag as shown, or for a luggage tag or label of any desired type, or as a sign, etc. Its use as a sign is shown in FIG. 6, where a panel 12 is bonded or secured in any other way to a rigid backing member 40 which may be hung on a support or provided with a stake for ground mounting.

The invention has been described in detail with particular reference to preferred embodiments thereof, but it will be understood that variations and modifications can be effected within the spirit and scope of the invention.

I claim:

1. A method of producing a panel having a highly recognizable indicia display thereon, said method comprising:

providing a panel of sheet-like material with a substratum of a first selected property and at least one superstratum of a second selected property contrasting with the first property and connected to the substratum;

the superstratum and the substratum each being formed of meltable material;

providing an indicia-forming tool having a heated stylus;

pressurally applying the stylus of the tool to the superstratum and moving it along the superstratum in a predetermined path to melt localized portions of the material of the superstratum throughout its thickness as the stylus progressively comes in contact therewith and forcing the melted portion of the superstratum out of the path of movement of the tool to leave the corresponding portions of the substratum exposed to define indicia of said first selected property with a background on the superstratum of said second selected property;

causing the melted portion of the superstratum to solidify in displaced position forming a ridge above the surface of the panel and along the margins of the indicia;

applying the tool with sufficient pressure to melt a portion of the substratum and cause the melted portion of the substratum to be displaced and to flow over the superstratum ridge; and causing the melted portion of the substratum to solidify in displaced position extending over the ridge formed from the superstratum to increase the recognizability of the indicia by forming a border around the indicia of said first selected property.

2. A method, as claimed in claim 1, wherein:

said selected property of said substratum is that it contains magnetic material so that the indicia formed therein can be read by an electronic scanner.

3. A method, as claimed in claim 1, wherein:

said selected property of said substratum is that it contains a material having different heat reflecting properties than said superstratum so that the indicia formed therein can be read by an infrared scanner.

4. A method, as claimed in claim 3, wherein:

said substratum contains an oxide.

5. A method of producing a panel having a high visibility indicia display thereon, said method comprising:

providing a panel of sheet-like material having a substratum of a first selected color and at least one superstratum of a second selected color contrasting with the first color and bonded to the substratum, said superstratum and said substratum being formed of meltable material;

providing an indicia-forming tool having a heated character forming element;

pressurally applying the character forming element of the tool to the superstratum and moving it in a predetermined path to melt localized portions of the material of the superstratum through its thickness as the character forming portion progressively comes into contact therewith and forces the melted portion of the superstratum out of the path of movement of the tool to be displaced toward the cooler unheated portions thereof to leave the corresponding portions of the superstratum exposed to define indicia with a contrasting background;

pressurally applying the character forming element to the substratum in the area below the melted portion of the superstratum to melt a portion of the substratum and forcing the melted portion of the substratum over the displaced portions of the substratum out of the path of the tool;

causing the melted portion of the superstratum to solidify in displaced position in a bead extending above the surface of the unheated portions of the panel and along the margins of the indicia; and causing the melted portion of the substratum to solidify in displaced position extending over the bead formed from the superstratum to increase the visibility of the indicia by forming a border around the indicia of a contrasting color to the superstratum and serve as a protective barrier.

6. An indicia-displaying article comprising:

a laminated panel including a substratum and at least one superstratum of tough, pliable, weatherproof material;

the substratum and superstratum having selected contrasting colors;

recesses of predetermined design formed through the superstratum to expose corresponding portions of the substratum to define indicia with a contrasting background;

ridges of the material of the superstratum extending above the surface thereof and along the margins of the indicia; and portions of said substratum extending over said ridges wherein said ridges are a border of contrasting color to the surface of said superstratum to increase the visibility of the indicia and serve as protective barriers.

* * * * *

UNITED STATES PATENT AND TRADEMARK OFFICE

CERTIFICATE OF CORRECTION

PATENT NO. : 4,365,436

DATED : December 28, 1982

INVENTOR(S) : Eugene B. Ritchey

It is certified that error appears in the above-identified patent and that said Letters Patent is hereby corrected as shown below:

The title page should be deleted to appear as per attached title page.

On the title page, after the abstract "6 Claims, No Drawings" should read --5 Claims, 11 Drawing Figures--.

Sheets 1 and 2 of the drawings should be included to appear as per attached sheets.

Column 6, claim 6, lines 26-43, should be deleted.

Signed and Sealed this

*Eighteenth* Day of *October 1983*

[SEAL]

*Attest:*

GERALD J. MOSSINGHOFF

*Attesting Officer*

*Commissioner of Patents and Trademarks*

United States Patent [19]

Ritchey

[11] 4,365,436

[45] Dec. 28, 1982

[54] DISPLAY PANEL AND METHOD OF MAKING SAME

[76] Inventor: Eugene B. Ritchey, Rte. 2, Box 58, Brighton, Colo. 80601

[21] Appl. No.: 144,699

[22] Filed: Apr. 28, 1980

Related U.S. Application Data

[63] Continuation-in-part of Ser. No. 23,547, Mar. 26, 1979, abandoned, which is a continuation of Ser. No. 755,646, Dec. 30, 1976, abandoned.

[51] Int. Cl.[3] ..... G09F 19/00; B05D 3/00; B41L 1/16; B26D 3/08

[52] U.S. Cl. ..... 40/615; 264/293; 40/616; 427/276; 427/277; 101/150; 83/880; 428/172; 434/81

[58] Field of Search ..... 40/616, 615; 101/150, 101/401.1; 282/28 R, 27.5; 400/120, 134.4, 134.5; 427/270, 271, 264, 272, 273, 274, 276, 277; 434/84, 81; 219/229, 227; 346/77 E, 77 R, 135.1, 139 C; 83/879, 880; 264/293; 428/29, 40, 142, 172, 212, 526

[56] References Cited

U.S. PATENT DOCUMENTS

| | | | |
|---|---|---|---|
| 469,033 | 2/1892 | Allen | 40/615 |
| 1,596,017 | 8/1926 | Harmisch | 427/277 |
| 1,674,047 | 6/1928 | Bombard | 427/277 |
| 2,135,538 | 11/1938 | Sherman et al. | 282/28 R |
| 2,224,043 | 12/1940 | Fluckiger | 427/272 |
| 2,739,909 | 3/1956 | Rosenthal | 346/135.1 |
| 3,035,267 | 5/1962 | Vögtlin | 346/77 R |
| 3,063,864 | 11/1962 | Norman | 101/150 |
| 3,198,688 | 8/1965 | Yoder | 427/276 |
| 3,320,089 | 5/1967 | Bourgeois | 346/135.1 |
| 3,379,814 | 4/1968 | Bracey, Jr. | 83/880 |
| 3,453,097 | 7/1969 | Hafner | 83/880 |
| 3,574,657 | 4/1971 | Burnett | 427/271 |
| 3,578,538 | 5/1971 | Prosser et al. | 40/615 |
| 3,683,408 | 8/1972 | Kinley et al. | 346/77 R |
| 3,699,644 | 10/1972 | Cocca | 83/880 |
| 3,940,864 | 2/1976 | Kanzelberger | 40/616 |
| 3,961,112 | 6/1976 | Genevitz et al. | 40/616 |
| 4,027,052 | 5/1977 | Thompson | 427/272 |

*Primary Examiner*—Gene Mancene

*Attorney, Agent, or Firm*—Fields, Lewis, Pittenger & Rost

[57] ABSTRACT

The process of displaying indicia on a panel includes forming a panel with a substratum of a first selected material and at least one superstratum of a second contrasting material attached to the substratum. At least the superstratum is meltable, and preferably both layers are formed of tough, pliable, weatherproof plastic such as polyurethane. A heated indicia-forming tool is pressurally applied selectively to the superstratum to melt localized portions of its material throughout its thickness and force it out of the path of movement of the tool, leaving corresponding portions of the substratum exposed to define indicia with a contrasting background. The method can include also melting a portion of the substratum, having a contrasting color to the superstratum and causing a portion of the substratum to flow up over the melted raised portion of the superstratum along the edge of the melted area to form highly visible indicia on the panel.

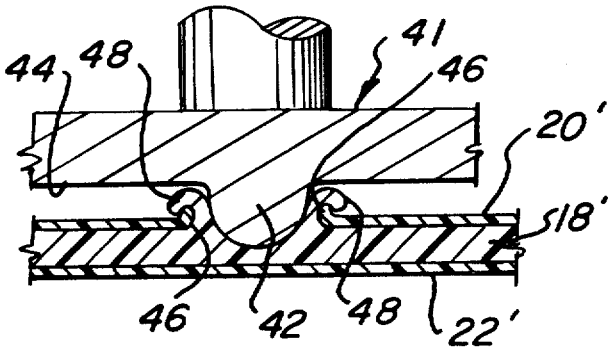

6 Claims, No Drawings